US007780402B2

(12) United States Patent
Buschkopf

(10) Patent No.: US 7,780,402 B2
(45) Date of Patent: Aug. 24, 2010

(54) SEAL CHAMBER CONDITIONING VALVE FOR A ROTODYNAMIC PUMP

(75) Inventor: Kevin Buschkopf, Monona, WI (US)

(73) Assignee: Weir Slurry Group, Inc., Madison, WI (US)

( * ) Notice: Subject to any disclaimer, the term of this patent is extended or adjusted under 35 U.S.C. 154(b) by 753 days.

(21) Appl. No.: 11/699,902

(22) Filed: Jan. 30, 2007

(65) Prior Publication Data

US 2008/0181765 A1 Jul. 31, 2008

(51) Int. Cl.
*F01D 11/00* (2006.01)

(52) U.S. Cl. ..... 415/39; 415/47; 415/110

(58) Field of Classification Search ..... 415/39, 415/902, 229, 110, 47, 25, 169.1, 111, 112, 415/168.1, 168.2; 277/317, 318, 319, 320, 277/926, 408

See application file for complete search history.

(56) References Cited

U.S. PATENT DOCUMENTS 4,532,614 A 7/1985 Peppers
4,691,620 A 9/1987 Kao
5,195,867 A 3/1993 Stirling
5,605,436 A 2/1997 Pedersen
5,772,396 A 6/1998 Rockwood
5,803,463 A * 9/1998 Brooks et al. ..... 277/361
6,126,038 A 10/2000 Olegnowicz
6,257,503 B1 7/2001 Baudin
6,485,263 B1 11/2002 Bryant et al.
6,918,252 B2 7/2005 Zimron et al.
2005/0247061 A1 11/2005 Zimron et al.

* cited by examiner

*Primary Examiner*—Edward Look
*Assistant Examiner*—Dwayne J White
(74) *Attorney, Agent, or Firm*—Morris O'Bryant Compagni

(57) ABSTRACT

In a rotodynamic pump, a seal chamber conditioning valve mechanism is positioned at least partially within the seal chamber of the pump to selectively and intermittently deliver fluid to or discharge contents from the seal chamber to modify the condition or content of the seal chamber and effectively protect the mechanical seal from failure due to, for example, built up solids or the presence of air. The conditioning valve mechanism may be actuated by a control device in communication with monitoring apparatus that determines the condition of the seal chamber, and particularly the mechanical seal face.

18 Claims, 4 Drawing Sheets

SEAL CHAMBER CONDITIONING VALVE FOR A ROTODYNAMIC PUMP

BACKGROUND OF THE INVENTION

1. Field of the Invention

This invention relates to rotodynamic pumps of the type typically used for processing or handling slurries. Specifically, this invention relates to structures and methods for controlling the conditions and content of a chamber surrounding the mechanical seal arrangement used with equipment such as rotodynamic pumps.

2. Description of Related Art

Rotodynamic pumps generally comprise an impeller which is connected to a drive shaft, and a pump casing in which the impeller rotates. Fluid processed by the pump can move to the area between the impeller and the drive side of the casing, around the drive shaft. Therefore, a mechanical seal arrangement is provided for sealing the drive shaft from leakage of fluid around the drive shaft. The mechanical seal of the drive shaft is often cooled and/or lubricated with a liquid flushed near the seal. Sometimes, the fluid used for flushing the system is that which is being processed by the pump. Thus, flushing systems in conjunction with mechanical seals in clear water and chemical processing pumps are well known.

Exemplar flushing systems are disclosed in U.S. Pat. No. 5,605,436 to Pedersen and U.S. Pat. No. 5,772,396 to Rockwood. The '396 patent exemplifies a seal construction where soft seal faces are employed an annulus is formed between the seal rotating face and the stationary stuffing box. One resulting effect of the '396 configuration is a high potential for dry running at the seal face if flushing of the seal is not continuously maintained.

In rotodynamic pumps that process fluid with entrained solids, i.e., slurries, the mechanical seal is also subject to wear from solids coming into contact with the seal. In certain rotodynamic pumps that are used for processing slurries, an expanded area, or seal chamber, may be provided around the mechanical seal. The enlarged seal chamber, defined generally between the back of the impeller and the pump casing, provides a stilling chamber and seal environment which is relatively high in pressure, low in air and low in turbulence. The seal chamber also provides an area through which fluid that is processed by the pump can be circulated at a lower velocity and, hence, higher pressure, to cool and/or clean the seal mechanism.

In some systems, the cooling fluid is pumped into the seal chamber at increased pressures to keep the flushing fluid moving out of the seal chamber toward the pump casing. In others, a fluid is caused to circulate in a sweeping manner in the seal chamber to cool the seal faces, as disclosed in U.S. Pat. No. 5,195,867 to Stirling. In the '867 patent, pumped fluid is circulated through the seal chamber at a low velocity and relatively high pressure to increase the likelihood that the seal chamber will operate in a positive pressure and to reduce the likelihood of air collecting, since air will always pass from a high pressure area to a low pressure area.

With certain types of slurries, however, particularly those that contain high concentrations of air, solids or a suspension of air and solids, pockets of air can collect in the area of the seal faces and cause a dry running condition. Further, collection of solids about the seal faces can cause wear on the mechanical seal or, if the solids accumulate to a large enough size, the accumulated large solids can break off the surfaces within the seal chamber and damage the seal faces. Failure of the mechanical seal can, therefore, be caused by dry running conditions, by wear due to exposure to solids accumulated in the seal chamber or by actual damage brought about by collision with large agglomerations of solids.

Known flushing or cooling systems for mechanical seals are not structured to address these problems. For example, known systems may include one or more flushing apertures positioned near the seal faces to cool or lubricate the seal face, but such apertures are not structured to control the amount of flushing liquid delivered to the seal face, and actual damage to the seal face can occur if, for example, cooling liquid strikes a high temperature seal that has been running under dry conditions. Nor are known flushing systems structured or positioned to remove or condition solids accumulations in the seal chamber. Additionally, known flushing systems, when flushed with a solids-containing fluid in close proximity to a seal face, can cause wear or damage. These known flushing systems need to operate continuously to allow the seal to function. Failure or interruption of the flushing system will ultimately cause the seal to fail.

Therefore, it would be advantageous in the art to provide a seal chamber conditioning mechanism for modifying the condition or content of the seal chamber, particularly responsive to known conditions in the seal chamber that might potentially cause damage to the mechanical seal, such as dry running conditions or potentially damaging solids accumulation. Further, it would be beneficial to provide a system which operates intermittently to clean and/or condition the seal chamber in order to minimize the dilution of the slurry mixture, and one which operates as needed depending on the conditions of the seal chamber.

BRIEF SUMMARY OF THE INVENTION

In accordance with the present invention, a valve mechanism, positioned in the seal chamber of a rotodynamic pump, is structured to provide selective modification of the contents or condition of the seal chamber to assure proper operation and condition of the mechanical seal at all times, thereby improving the seal life of the pump. While the seal chamber conditioning valve mechanism of the present invention is described for use in a centrifugal pump of the slurry type, the valve mechanism may be adapted for use in other types of equipment that use mechanical seals. including for example, clear liquid pumps and turbines.

The valve mechanism of the present invention is comprised of a housing that is positioned, at least partially, in the seal chamber of a rotodynamic pump to effect delivery of fluid to the seal chamber, including the seal faces of the mechanical seal. The valve mechanism further comprises a first end having a selectively movable valve and valve seat which are oriented inwardly to the seal chamber. In an exemplar embodiment of the invention, the valve is biased by spring means to be registered against the valve seat. Other devices for selectively moving the valve relative to the valve seat may be implemented.

A second end of the housing, opposite the valve seat, is positioned to reside outside the seal chamber, and is preferably accessible from outside the pump casing of the pump. An opening at the second end provides access to the biased valve such that the valve can be manually operated. Additionally, the opening at the second end of the housing may preferably be threaded to receive a similarly threaded conduit, such as a hose or pipe fitting, that delivers fluid to the valve housing. The fluid delivered by the conduit is pressurized to cause the valve to disengage from the valve seat, thereby providing fluid to the seal chamber. The fluid may be provided from, for example, a pressurized tank or source other than the pump.

Alternatively, the conduit may be connected at its other end to the outlet of the pump so as to deliver fluid processed by the pump to the valve for delivery to the seal chamber. As used herein, "fluid" may include both liquid, gas or mixtures thereof. The valve mechanism may include a pressure and flow limiting device that modifies the flow of fluid through the valve.

The valve is generally conically shaped, thereby effecting a conical-like spray of fluid into the seal chamber. Consequently, the positioning of the valve mechanism in the seal chamber and the conical-like spray pattern produced by the valve enables fluid to be delivered about the surfaces of the seal chamber to flush down and remove accumulated solids from the surfaces of the seal chamber. The valve mechanism is also directed to spray in the direction of the seal face of the mechanical seal to provide cooling and lubrication of the seal face. The valve mechanism is also positioned in the seal chamber to enable the conical-like spray of the valve to break up large air bubbles and to disperse the toroidally-shaped air bubble mass that may form about the pump shaft at high air concentrations. The dissipation of air bubbles from the area causes the seal chamber environment to improve by modifying the seal chamber condition to a more homogeneous mixture of fluid and solids.

The valve mechanism, as noted above, is selectively operable manually or by introduction of pressurized fluid to the second end of the valve mechanism. As such, the valve mechanism can be manually actuated to open the valve and thereby effect a discharge from the seal chamber as may be required to modify the solids or gas (e.g., air) content of the seal chamber.

When an external source of fluid is provided, via a fluid conduit, to the valve mechanism, the configuration of the valve assures that the valve will center properly on the valve seat and will close properly. Application of pressurized fluid to the housing provides a flushing of the valve housing to eliminate the accumulation of solids in the valve housing.

The spring-loaded construction of the valve, in an exemplary embodiment of the invention, enables the valve to close if excessive pressurization of the valve occurs. That is, the conical spring that seats the valve will close upon itself if the amount of pressure exerted on the valve exceeds a selected load on the conical spring. Automatic closure of the valve mechanism prevents excessive flow of pressurized fluid and prevents excessively high pressure flushing fluid from reaching the seal chamber and seal face, which would introduce undesirable turbulence into the seal chamber. The conical spring about the valve has an added advantage of acting as a restrictive orifice such that as pressure rises in the valve housing and the valve opens, the coils of the spring close together limiting the flow of fluid through the valve mechanism. Thus, the conical spring provides a pressure and flow limiting device. The coil spring is also self-cleaning since solids cannot build up around the spring as it flexes.

The number of valve mechanisms positioned in the seal chamber may vary. Preferably, however there may be at least three valve mechanisms evenly spaced circumferentially about the drive shaft. As many as six or more valve mechanisms may be evenly spaced about the drive shaft. All of the valve mechanisms may operate similarly to both selectively introduce or discharge fluid from the seal chamber. Alternatively, some of the valve mechanisms may be selectively actuated to discharge contents from the seal chamber while others may be selectively actuated to introduce flushing media into the seal chamber in, for example, an alternating pattern of valves about the drive shaft. Still other valve mechanisms may be used to monitor conditions of the seal chamber, such as pressure, temperature and the presence of, for example, air and excessive solids.

The seal chamber conditioning valve mechanism of the present invention can be selectively actuated to either discharge contents from or introduce flushing fluid into the seal chamber upon determination of a particular condition within the seal chamber or the seal faces. That is, upon determination, for example, that too much gas is present in the seal chamber, thereby potentially leading to the formation of a gas bubble and dry running of the mechanical seal, some or all of the valve mechanisms may be manually actuated to release gas from the seal chamber, while others may be actuated to introduce flushing fluid into the seal chamber to dissipate the larger air pockets and lubricate or cool the seal face. The determination of the condition or status of the environment within the seal chamber may be monitored by any suitable means, such as a thermocouple. A monitoring element may be positioned in the seal chamber, preferably at or near the seal face.

It is the unique ability to selectively actuate the seal chamber conditioning valve mechanism of the present invention to modify the condition of the environment within the seal chamber or modify its contents that presents an improvement in preservation and maintenance of the mechanical seal in rotodynamic pumps. That is, the ability to determine stress on or imminent failure of the seal due to adverse conditions in the seal chamber, and to modify the conditions within the seal chamber to save the seal, provides the most significant advantage via the present invention. These and other advantages will become more apparent upon reference to the description provided hereinafter.

BRIEF DESCRIPTION OF THE SEVERAL VIEWS OF THE DRAWINGS

In the drawings, which currently illustrate the best mode for carrying out the invention.

DETAILED DESCRIPTION OF THE INVENTION

Figure 1:
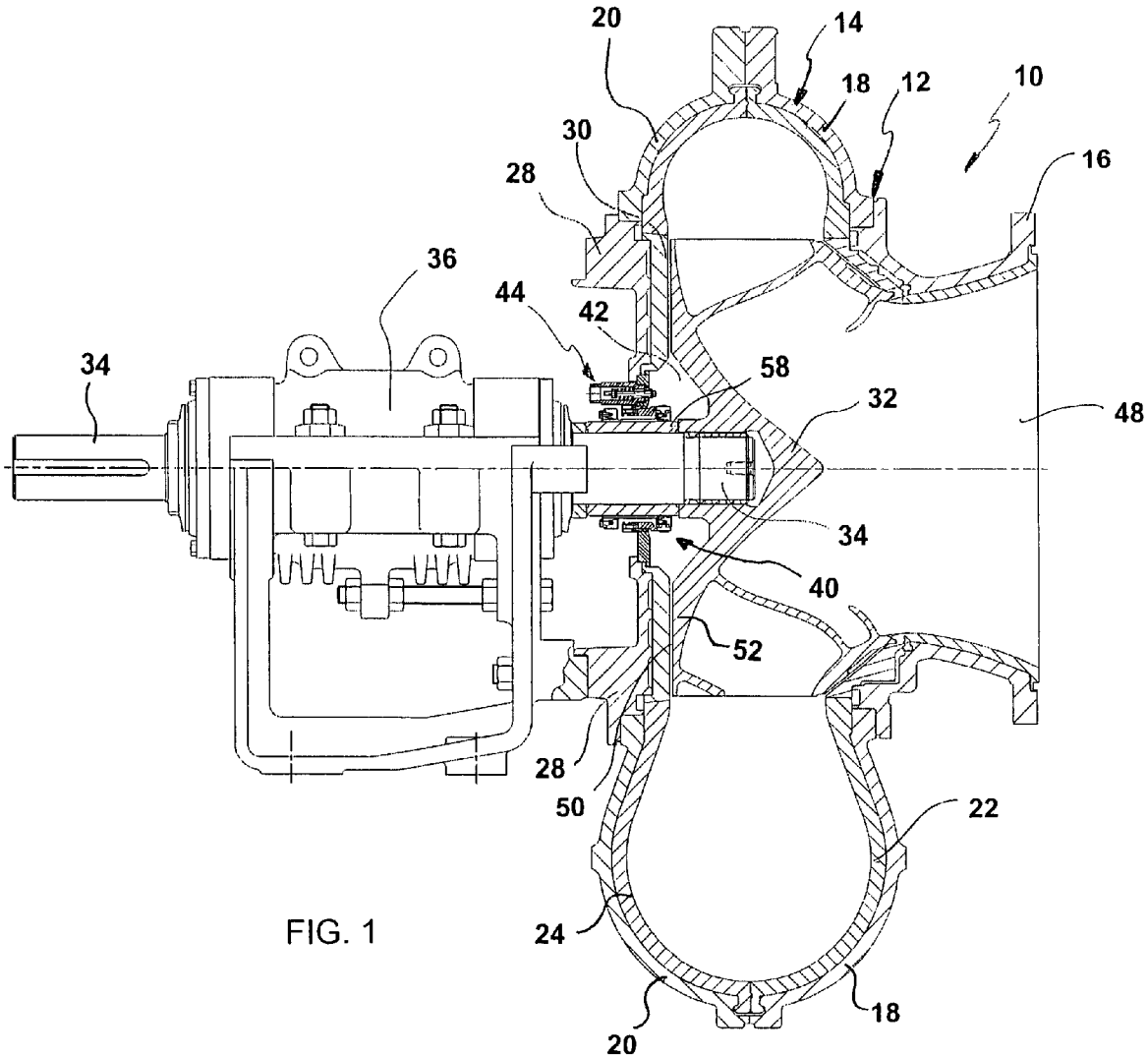
FIG. 1 is a view in longitudinal cross section of a centrifugal pump illustrating the general elements of the pump, including the seal chamber, and the position of the conditioning valve of the invention.

FIG. 1 illustrates, in partial cross section, a centrifugal pump 10 of the type used to process slurries. The pump 10 generally comprises a pump casing 12 which, in turn, comprises a volute casing 14 to which is attached to a suction inlet casing 16. As shown, the volute casing 14 may preferably comprise a front casing 18 and a back casing 20. In the particular embodiment of the pump 10 shown, casing liners 22, 24 are installed on the inner surface of the front casing 18 and back casing 20. The pump 10 further comprises a frame plate adaptor 28 that attaches to the back casing 20. A frame plate liner insert 30 is positioned adjacent the frame plate adaptor 28.

An impeller 32 is positioned in the pump casing 12 and is secured to a pump shaft 34 that extends through the frame plate adaptor 28. The pump shaft 34 also extends through a bearing housing 36 in which is located a set of bearings (not shown) which support the pump shaft 34. The pump shaft 34 is also keyed for attachment to a motor or drive belt mechanism (not shown). The features of a pump bearing housing 36 and motor are well-known in the art and are not discussed in further detail herein, but will be known to those of skill in the art.

A mechanical seal 40 is positioned about the pump shaft sleeve 58 at the point of extension of the pump shaft 34 through the frame plate adaptor 28. The mechanical seal 40 prevents fluid from leaking out of the pump 10 and around the pump shaft 34. In this particular embodiment of a slurry pump 10, the pump 10 is configured with a seal chamber 42 that comprises an enlarged area about the mechanical seal 40. The relative positioning of a seal chamber conditioning valve mechanism 44 of the present invention is illustrated in FIG. 1

It can be appreciated from the view of the pump 10 in FIG. 1 that fluid enters the inlet 48 of the pump 10 by suction created by the rotation of the impeller 34 within the casing 12. The impeller 32 directs the fluid into the volute 14 where it is discharged from an outlet (no shown) tangentially oriented to the volute. The pressure of the processed fluid causes fluid to travel through a gap 50 formed between the back shroud 52 of the impeller and frame plate liner insert 30 of the pump 10, and into the seal chamber 42. Solids and gases are typically entrained in the fluid. Solids may then build up in the seal chamber and may even accumulate on the frame plate liner insert 30 and the back shroud 52 of the impeller 34. This condition causes the seal face temperature to rise. Removal of the solids and gases is then required to keep the seal from failing. The valve mechanism 44 of the present invention thus serves to quickly modify the condition or contents of the seal chamber to allow the seal to continue to operate without leakage until the cause of the problem is corrected.

Figure 2:
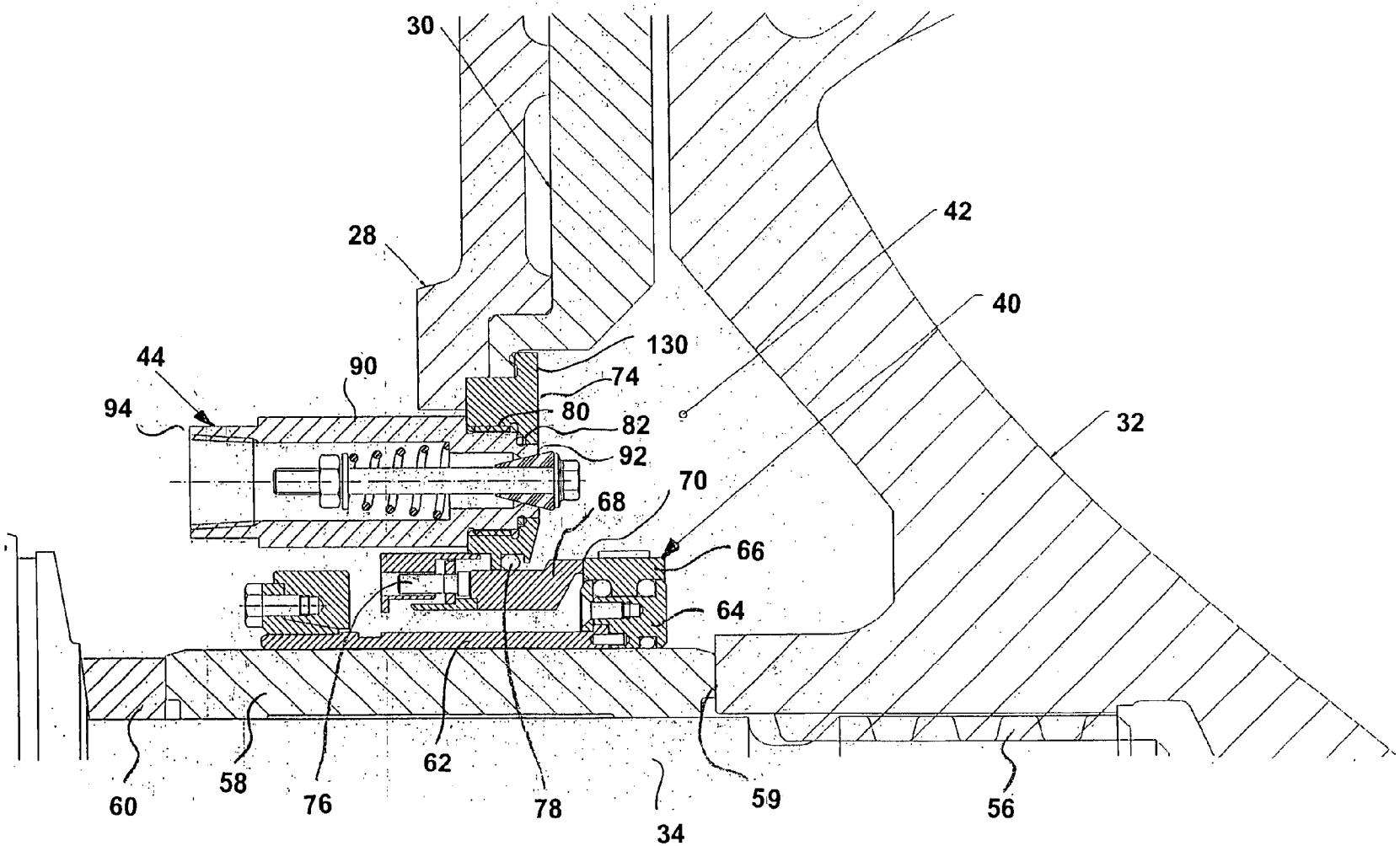
FIG. 2 is an enlarged view in longitudinal cross section of the seal chamber of the pump further illustrating the detail of the conditioning valve.

FIG. 2 provides an enlarged view of one half of the pump shaft 34 and seal chamber 42, better illustrating the elements of the mechanical seal 40 and valve mechanism 44. As previously described, the pump shaft 34 is connected to the impeller 32 by appropriate means, here illustrated as a threaded engagement 56. A pump shaft sleeve 58 surrounds the pump shaft 34 and is positioned axially between the hub portion 59 of the impeller 32 and a release collar 60. Both the pump shaft sleeve 58 and release collar 60 rotate with the pump shaft 34.

The mechanical seal 40 comprises a mechanical seal sleeve 62 that is positioned about the pump shaft sleeve 58 and rotates with the pump shaft sleeve 58. A rotating seal face holder 64 is secured to the mechanical seal sleeve, as shown in FIG. 2, and rotates with the mechanical seal sleeve 62. The rotating seal face holder 64 provides support for a mechanical seal rotating face 66 which rotates with the rotating seal face holder 64. A stationary mechanical seal face 68 abuts the mechanical seal rotating face 66 and thereby defines a seal face 70 therebetween. The stationary mechanical seal face 68 is secured to a mechanical seal gland plate 74 by means of a plurality of drive pins 76. Though not shown, a plurality of biasing springs are positioned between the mechanical seal gland plate 74 and the stationary mechanical seal face 68 to maintain a tight fit between the stationary seal face 68 and rotating face 66 at the seal face 70. An o-ring 78 is also positioned between the mechanical seal gland plate 74 and the stationary mechanical seal face 68 to prevent leakage of fluid therebetween.

The seal chamber conditioning valve mechanism 44 of the present invention is shown positioned through an opening 80 formed in the mechanical seal gland plate 74. While only one valve mechanism 44 is shown, it is understood that a plurality of such valve mechanisms 44 may preferably be distributed circumferentially around the pump shaft 34 and positioned, as shown, through the gland plate 74. The valve mechanism 44 may preferably be threadingly received into the opening 80 of the gland plate 74. An o-ring 82 is positioned between the valve mechanism 44 and the threaded opening 80. The valve mechanism 44 comprises a housing 90 which has a first end 92 that is oriented toward the interior of the seal chamber 42 and a second end 94 that is positioned external to the pump casing 12 thereby providing access to actuation of the valve mechanism 44.

Figure 3:
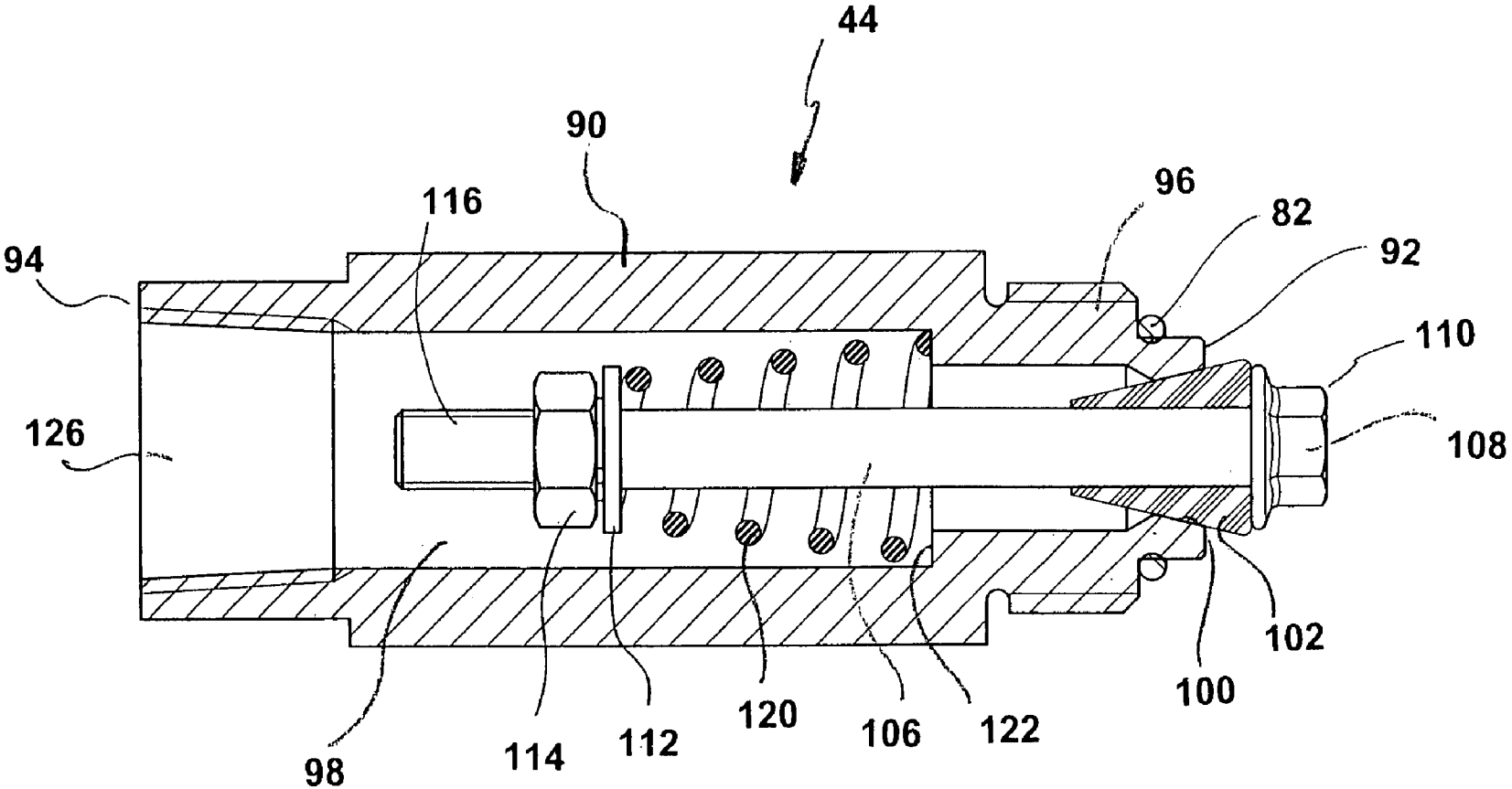
FIG. 3 is an enlarged view in cross section of the seal chamber conditioning valve of the present invention.

Further detail of the seal chamber conditioning valve mechanism 44 can be seen in FIG. 3 where, notably, the housing 90 is provided with a threaded neck portion 96 that is received into a correspondingly threaded opening 80 (FIG. 2) in the gland plate 74. It can also be seen that the housing 90 is formed with an internal bore 98 that extends from the first end 92 to the second end 94 of the valve mechanism 44. At the first end 92 of the valve mechanism 44, the internal bore 98 defines a valve seat 100 against which a valve 102 registers when the valve mechanism 44 is in a closed position, as illustrated.

The valve 102 is connected to a valve stem 106 that is concentrically positioned within the bore 98 of the housing 90. In the particular embodiment illustrated, the valve stem 106 is a hex flange bolt having a flanged hex head 108 at a first terminal end 110 against which the valve 102 is positioned. A flat washer 112 and locknut 114 are threaded onto the opposing second end 116 of the valve stem 106. A conically configured spring 120 is positioned to encircle the valve stem 106 and is biased between the flat washer 112 and an inwardly extending shoulder 122 of bore 98.

A second end 126 of the housing 90 of the valve mechanism 44 is configured as a threaded female coupling 126 to which a fluid conduit, such as a hose or other pipe fitting (not shown), may be attached for introducing fluid into the valve mechanism 44. The coupling 126 also provides an opening through which access may be made to the second end 116 of the valve stem 106 for manually actuating the valve 102, as described more fully below.

The valve 102 is conically shaped and the valve seat 100 against which the valve 102 registers is configured with a complimentary conical shape. Consequently, when fluid is introduced into the bore 98 of the valve housing 90 through the coupling 126, the pressure of the fluid causes the valve 102 to move out of registration with the valve seat 100 and a conically shaped spray is produced.

Referring to FIG. 2, it can be seen that the first end 92 of the housing 90 of the valve mechanism 44 is flush with the inner-facing surface 130 of the gland plate 74. The valve mechanism 44 is, therefore, positioned to provide a conical spray to the gland plate 74 and the seal face 70 to wash away solids, and particularly solids that may have accumulated on those surfaces or structures. The distribution of a plurality of such valve mechanisms 44 circumferentially about the pump shaft 34 ensure that the seal chamber 42 is substantially flushed of solids. The distribution of the valve mechanisms 44 about the pump shaft 34 further assures a comprehensive dissipation of large air pockets that might have formed in the seal chamber 42, particularly in the area of the seal face 70. The conical spray provided by the valve 102 breaks larger air pockets into smaller bubbles that are dispersed more effectively into the contents of the seal chamber 42. The position of the first end 92 of the valve housing 90 flush with the surface 130 of the gland plate 74 also avoids the production of turbulence in the seal chamber when displacement fluid is being introduced by the conical spray.

The conical shape of the valve 102 also enables an even flow of fluid through the bore 98 of the housing 90 and about the valve stem 106. This factor assures that solids are flushed from the valve mechanism 44. The conical shape of the spring 120, in combination with the conical shape of the valve 102, further assures that the valve stem 106 remains centered in the housing 90 and the conical shape of the spring 120 provides a pre-loaded condition that assures proper closing of the valve 102 against the valve seat 100.

Displacement fluid can be introduced into the coupling 126 of the valve mechanism 44 from a variety of sources. For example, process fluid can be taken from the outlet of the pump and circulated into the valve mechanism 44 by conduit means known in the industry. The displacement fluid can also be in the form of a gas or liquid supplied from an external source, such as a tank.

The valve mechanism 44 of the present invention is also structured to be manually actuated by accessing the valve stem 106 through the coupling 126. This may be accomplished by insertion of a tool through the coupling 126 that engages the second end 116 of the valve stem 106, thereby enabling movement of the valve stem 106 for disengagement of the valve 102 from the valve seat 100. The manual actuation of the valve mechanism 44 enables the valve mechanism 44 to be opened for discharge of air, fluid and solids from the seal chamber 42 as may be required. Once air, fluid and solids are discharged through the valve mechanism 44, any residual solids can be flushed from the valve mechanism 44 by closing the valve 102 and introducing fluid, from a fluid conduit connected to the coupling, into the valve housing 90.

Figure 4:
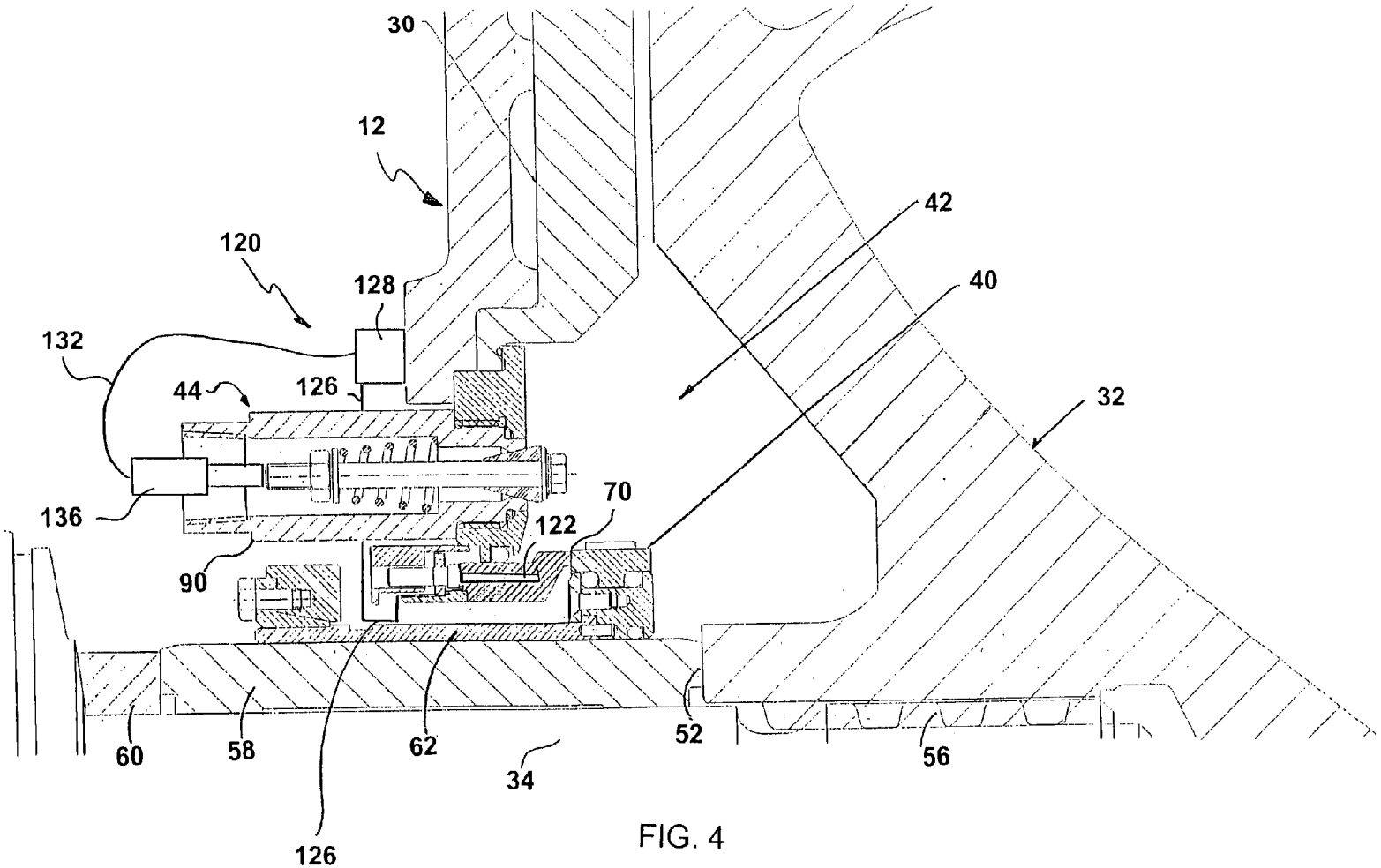
FIG. 4 illustrates schematically an embodiment of the invention which employs a system for monitoring conditions within the seal chamber.

The conditions of the seal chamber 42 and the seal face 70 may be monitored by any appropriate monitoring apparatus 120 or means to enable the valve 44 to be intermittently actuated as required to modify the conditions or content of the seal chamber 42. As illustrated schematically in FIG. 4, such monitoring apparatus may include, for example, a thermocouple 122 positioned at or near the seal face 70. The thermocouple 122 is capable of monitoring the temperature at the seal face 70 and producing a signal that is transmitted, such as by wire 126, to a control device 128 located outside the casing 12 of the pump. The control device 128 is in electrical and/or mechanical communication, such as via wire 132, with a solenoid valve 136 connected to the conditioning valve mechanism 44.

Thus, when data is sent from the thermocouple 122 to the control device 128 concerning the condition of the seal face 70 or the seal chamber 42, such as temperature, the control device 128 processes the data and determines when it may be appropriate to signal the valve 102 to open via action of the solenoid 136. The valve 102 opens to either allow discharge of some of the contents of the seal chamber 42 or to allow introduction of fluid through the valve mechanism 44 into the seal chamber. The control device 128 can, therefore, also control a source of fluid to provide that fluid to the valve housing 90 as conditions dictate. One or more control devices 128 can be used to operate a plurality of valves 44, and the control devices 128 can be made to intercommunicate data between the devices 128.

A centrifugal pump may be structured with a plurality of valve mechanisms 44 encircling the pump shaft 34, as described, where all of the valve mechanisms 44 are actuated at the same time and in the same manner. That is, all valve mechanisms 44 may be simultaneously actuated together to either introduce fluid into the seal chamber 42 or to discharge fluid from the seal chamber 42. Alternatively, the valve mechanisms 44 may be actuated individually or in alternating series (e.g., every other valve mechanism 44 being actuated to introduce fluid into the seal chamber 42) to provide a conditioning effect within the seal chamber 42 that is unique to the current condition of the seal chamber 42.

While the seal chamber conditioning valve mechanism of the present invention is particularly suited for modifying the conditions and content of a seal chamber in a centrifugal slurry pump, the valve mechanism of the invention may be adapted for use in any number of other types of pumps and for other purposes. Hence, reference herein to specifics of the structure and positioning of the valve mechanism of the invention is by way of example only and not by way of limitation.

What is claimed is:

1. A rotodynamic pump having a pump casing, an impeller secured to a pump shaft, a mechanical seal for sealing the pump shaft and a seal chamber surrounding the mechanical seal, further comprising a seal chamber conditioning device having at least one valve mechanism positioned through the pump casing and oriented within the seal chamber to modify the conditions and content of the seal chamber by intermittent and selective actuation of said at least one valve mechanism to deliver a fluid into said seal chamber.

2. The rotodynamic pump of claim 1 further comprising monitoring apparatus for monitoring the conditions of the seal chamber and signaling a control device in communication with said at least one valve mechanism to selectively and intermittently actuate said at least one valve mechanism responsive to perceived conditions in the seal chamber.

3. The rotodynamic pump of claim 2 wherein said monitoring apparatus comprises a thermocouple.

4. The rotodynamic pump of claim 3 wherein said at least one valve mechanism may be selectively and intermittently actuated to alternatively introduce fluid into the seal chamber or to discharge at least a portion of the contents of the seal chamber to the outside of the pump.

5. The rotodynamic pump of claim 1 wherein said at least one valve mechanism may be selectively and intermittently actuated to alternatively introduce fluid into the seal chamber or to discharge at least a portion of the contents of the seal chamber to the outside of the pump.

6. The rotodynamic pump of claim 1 wherein said at least one valve mechanism further comprises a valve housing having a valve seat and a valve positioned to register against said valve seat.

7. The rotodynamic pump of claim 6 wherein said valve is shaped to provide a conical-like spray directed into said seal chamber and said mechanical seal.

8. The rotodynamic pump of claim 6 further comprising a spring biased between said valve housing and a valve stem attached to said valve to enable selective actuation of said at least one valve mechanism.

9. The rotodynamic pump of claim 6 wherein said valve housing has an end positioned outside the pump casing which is configured to receive attachment of a fluid conduit thereto for providing flushing fluid to said at least one valve mechanism for introduction into the seal chamber.

10. The rotodynamic pump of claim 1 wherein said at least one valve mechanism is actuated manually.

11. The rotodynamic pump of claim 1 wherein said at least one valve mechanism is actuated mechanically.

12. The rotodynamic pump of claim 1 wherein said at least one valve mechanism further comprises a plurality of valve mechanisms positioned through the pump casing and distributed radially about said pump shaft, each said valve mechanism being actuated selectively and intermittently.

13. The rotodynamic pump of claim 12 wherein said plurality of valve mechanisms are structured to be actuated synchronously to discharge contents from the seal chamber or introduce flushing fluid into the seal chamber.

14. The rotodynamic pump of claim 12 wherein said plurality of valve mechanisms are structured to be variably actuated where a subset of said plurality are structured to discharge contents from the seal chamber and another subset of said plurality are structured to introduce flushing fluid into the seal chamber.

15. The rotodynamic pump of claim 14 wherein a further subset of said plurality of valve mechanisms are structured with monitoring apparatus for monitoring the conditions within the seal chamber.

16. The rotodynamic pump of claim 14 wherein said plurality of valve mechanisms are actuated by control means for actuating said plurality of valve mechanisms responsive to perceived conditions within the seal chamber.

17. The rotodynamic pump of claim 5 further comprising a pressure and flow limiting device connected to said valve mechanism.

18. The rotodynamic pump of claim 17 wherein said pressure and flow limiting device is a conical spring interconnected to a valve seat.

* * * * *